United States Patent [19]

Johnson

[11] Patent Number: 4,499,616

[45] Date of Patent: Feb. 19, 1985

[54] FLUSH VALVE

[75] Inventor: Dwight N. Johnson, El Toro, Calif.

[73] Assignee: Fillpro Products, Inc., San Marcos, Calif.

[21] Appl. No.: 55,768

[22] Filed: Jul. 9, 1979

Related U.S. Application Data

[63] Continuation of Ser. No. 927,151, Jul. 21, 1978, abandoned, which is a continuation of Ser. No. 718,048, Aug. 26, 1976, abandoned.

[51] Int. Cl.[3] ..... E03D 1/34

[52] U.S. Cl. ..... 4/393; 4/412

[58] Field of Search ..... 4/378, 392, 393, 395, 4/396, 403–405, 412, 415, 386; 251/228, 298; 137/855

[56] References Cited

U.S. PATENT DOCUMENTS

| | | | |
|---|---|---|---|
| 2,378,613 | 6/1945 | Young et al. | 4/392 X |
| 2,598,967 | 6/1952 | Bennett . | |
| 2,741,775 | 4/1956 | Schmidt . | |
| 2,756,437 | 7/1956 | Svabek, Jr. et al. . | |
| 2,763,872 | 9/1956 | Nelson . | |
| 2,767,406 | 10/1956 | Bennett . | |
| 2,774,972 | 12/1956 | Nelson et al. . | |
| 2,781,521 | 2/1957 | Schmidt et al. . | |
| 2,787,005 | 4/1957 | Zinkil . | |
| 2,801,425 | 8/1957 | Stambaugh | 4/393 |
| 2,810,915 | 10/1957 | Zinkil . | |
| 2,821,721 | 2/1958 | Nelson . | |
| 2,822,552 | 2/1958 | Zinkil et al. . | |
| 2,829,378 | 4/1958 | Nelson et al. . | |
| 2,830,302 | 4/1958 | Nelson et al. | 4/392 |
| 2,876,458 | 3/1959 | Schmidt et al. | 4/393 |
| 2,949,613 | 8/1960 | Svabek, Jr. et al. . | |
| 3,003,156 | 10/1961 | Alexander | 4/386 |
| 3,005,991 | 10/1961 | Richardson et al. . | |
| 3,158,873 | 12/1964 | De Lisle | 4/392 |
| 3,239,848 | 3/1966 | Zrolka . | |
| 3,360,803 | 1/1968 | Gross . | |
| 3,702,012 | 11/1972 | Bennett | 4/392 |
| 3,707,733 | 1/1973 | Gore et al. | 4/393 |
| 3,943,577 | 3/1976 | Woolf et al. | 4/325 |
| 3,962,731 | 6/1976 | Cheiten | 4/393 |

*Primary Examiner*—Stephen Marcus

*Attorney, Agent, or Firm*—Mason, Kolehmainen, Rathburn & Wyss

[57] ABSTRACT

A flush valve for use with a toilet tank assembly having a flush outlet surrounded by a valve seat, an overflow pipe, and a lift arm movable to initiate flow through the valve seat includes a one piece integral body of molded plastic material. The valve body includes a float fabricated on one end that is aligned with the valve seat to control flow therethrough. An integral beam is fabricated at another end of the body. The float and beam are interconnected by planar portions of the body. A mounting collar is also integrally formed on another planar portion of the body extending from the beam to the collar. The collar may be mounted on the overflow pipe to secure the valve to the toilet tank assembly. An elongated lift strap integrally fabricated with the body extends from the float member and includes a tooth structure for attachment to the lift arm. A reduced thickness integral hinge formed in the portion of the body between the mounting collar and the beam allows the beam to pivot with respect to the collar. Reduced thickness hinges in the portions connecting the float and the beam allow rotation of the float about the beam.

4 Claims, 5 Drawing Figures

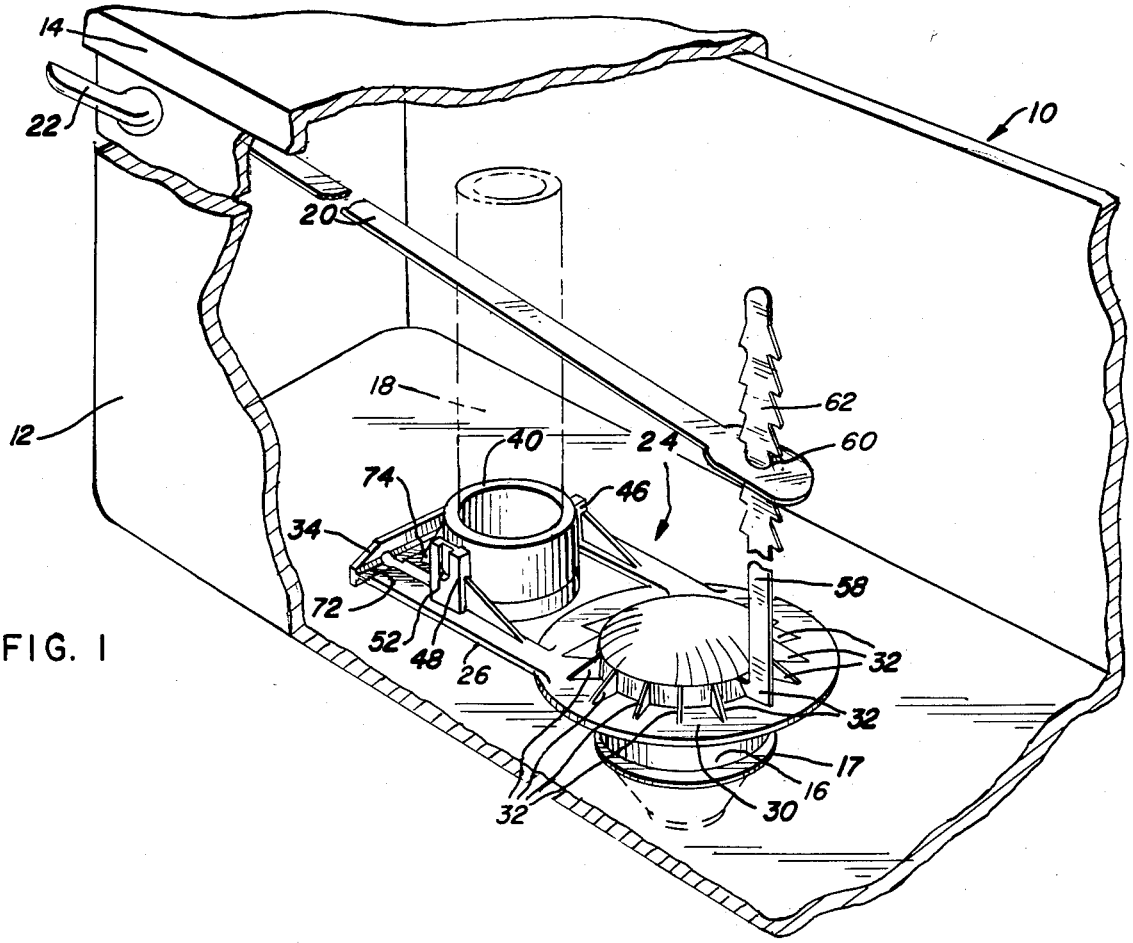
FIG. 1
FIG. 2
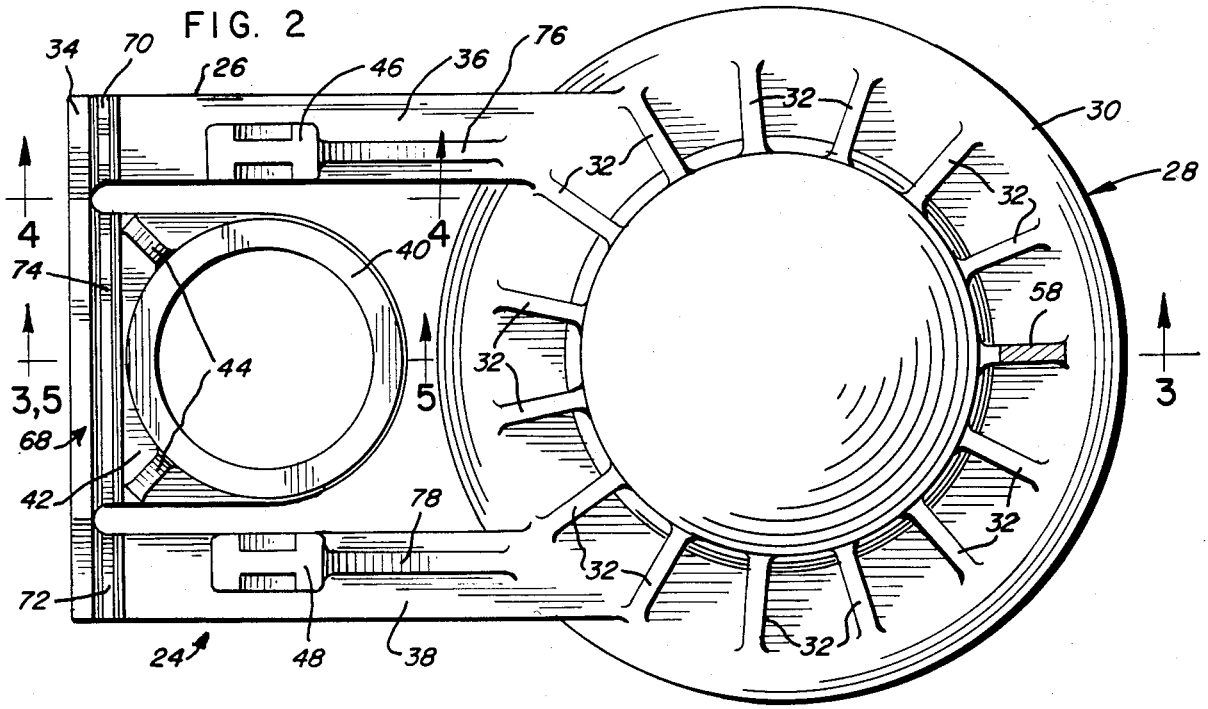

FLUSH VALVE

This is a continuation of application Ser. No. 927,151, filed July 21, 1978, abandoned, which is a continuation of parent application Ser. No. 718,048, filed Aug. 26, 1976.

BACKGROUND OF THE INVENTION

A. Field of the Invention

The present invention relates to a new and improved flush valve for a toilet tank assembly.

B. Description of the Prior Art

One type of prior art flapper flush valve includes an integral planar body having a float member defined on one end. The valve is mounted in the tank assembly of a toilet with the float aligned with the flush valve seat of the assembly to control flow of fluid from the toilet tank. Prior art valves also include a device such as a chain that is connected to the float and to the lift arm in the toilet tank assembly to lift the flush valve in response to movement of the lift arm.

In view of the forces imparted to the body of the flush valve during lifting of the float member that can result in deterioration of the material of the body, typical integral prior art flush valves are fabricated from a soft elastomeric material of a low durometer hardness. Typical prior art valves of this type are disclosed in U.S. Pat. Nos. 3,702,012 and 3,707,733. This employment of a soft material in fabricating the flush valve prevents the fabrication of a lift strap integrally formed with the flush valve since the stresses and forces applied to the lift strap during operation of the toilet by movement of the lift arm result in rapid deterioration of the soft material of the strap. An example of one solution to this problem is illustrated in U.S. Pat. No. 3,158,873. However, this prior art valve is expensive due to the additional assembly steps necessitated by molding the lift string of this prior art valve into the outer coating of the float.

SUMMARY OF THE INVENTION

An object of the present invention is to provide a new and improved flush valve to be employed in a toilet tank assembly.

Another object of the present invention is to provide a new and improved flush valve that includes an integral lift strap.

A further object of the present invention is to provide a new and improved flush valve that is fabricated from a molded plastic material and includes a compound hinge and a torque beam allowing the use of a material of a greater hardness.

An additional object of the present invention is to provide a flush valve having a new and improved structure for attaching the valve to the lift arm of a toilet tank assembly.

Briefly, the present invention relates to a new and improved flush valve to be employed in a toilet tank assembly including a flush valve seat to allow flow from the tank to the toilet bowl, an overflow pipe, and a movable lift arm. The flush valve includes a planar body of plastic material with a float member defined on one end. The flush valve is mounted within the toilet tank assembly by placing a mounting collar integrally formed on the planar body around the overflow pipe. The valve is mounted such that the float is aligned with the flush valve seat. The flush valve also includes an integral lift strap defined on or adjacent to the float member that may be connected to the lift arm in a novel fashion.

The flush valve is integrally formed from a relatively hard elastomeric material and as a result the integral lift strap is of ample strength. To allow easy lifting of the float despite the hardness of the material, two planar interconnecting portions extend from the float member to a torque beam. Reduced thickness hinges are formed in these portions to allow rotation of the float member relative to the beam. In addition, a similar hinge is formed in a portion of the body extending from the mounting collar to the torque beam to allow rotation of the beam relative to the mounting collar. In this fashion, movement of the float member is shared by pivoting these hinges in a compound hinge action, and the forces or stresses experienced by the various portions of the valve are reduced.

BRIEF DESCRIPTION OF THE DRAWINGS

The invention together with the above and other objects and advantages will be more fully understood from the following detailed description of the embodiment of the invention illustrated in the accompanying drawings, wherein:

FIG. 1 is a partially cut-away diagrammatic illustration of a toilet tank assembly including a perspective view of a flapper flush valve constructed in accordance with the principles of the present invention;

FIG. 2 is a top view of the valve of the present invention;

DESCRIPTION OF THE PREFERRED EMBODIMENT

Figure 3:
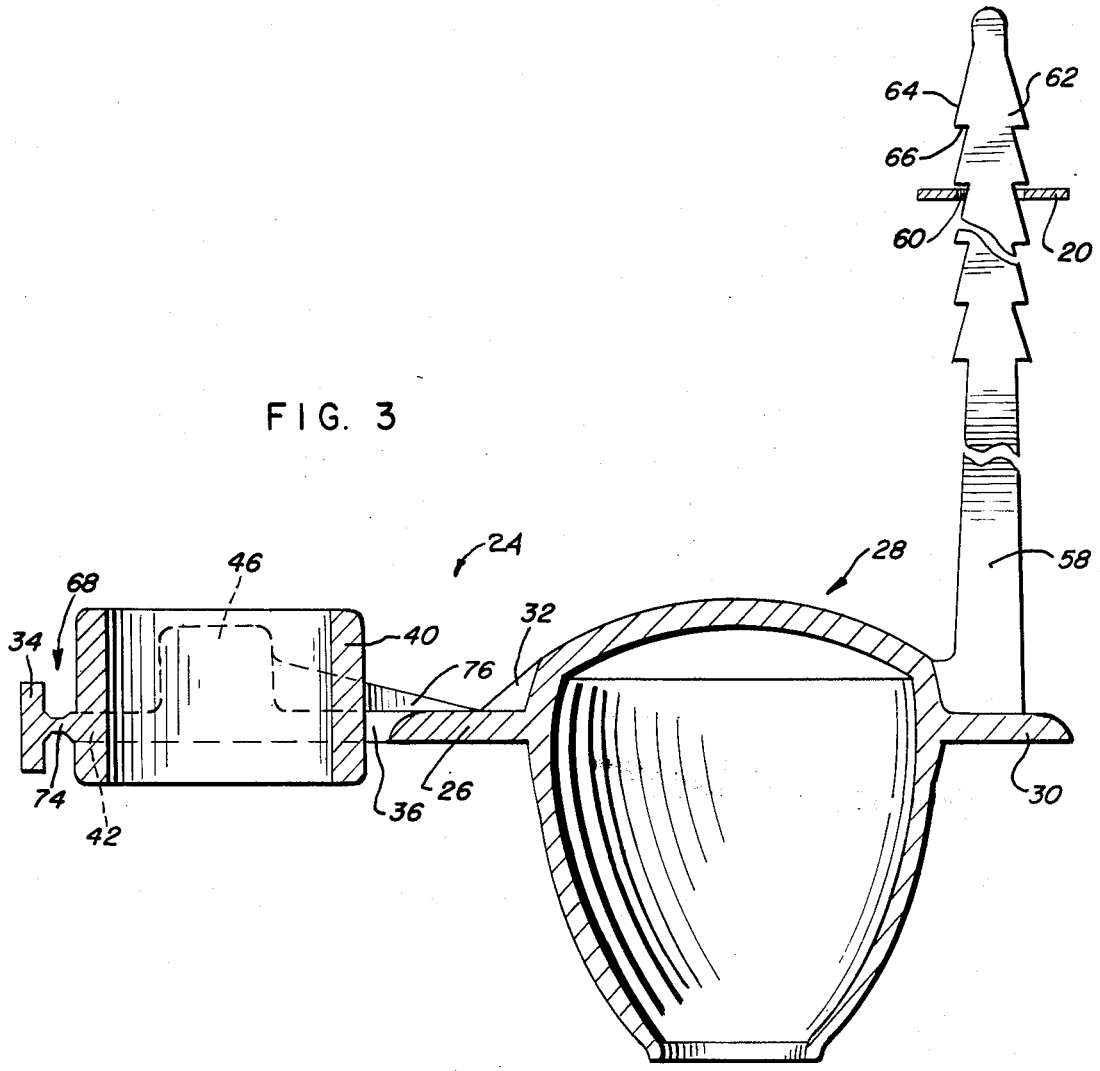
FIG. 3 is a sectional view taken along line 3—3 of FIG. 2.
Figure 4:
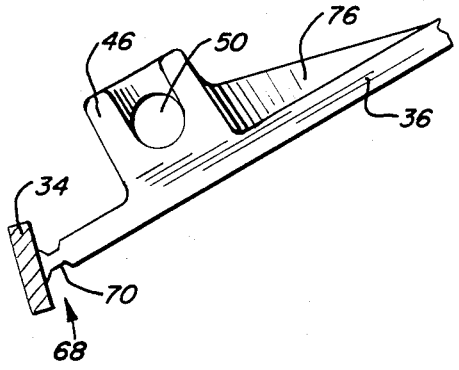
FIG. 4 is an fragmentary, sectional view taken along line 4—4 in FIG. 2 illustrating a portion of the valve in the open position

Have reference to the drawings, and initially to FIG. 1, there is illustrated a toilet tank assembly designated as a whole by the reference numeral 10. The assembly 10 includes a water holding tank 12 having a removable upper lid 14 that allows access to the inside of the tank 12. Located in the bottom of the tank 12 is a flush outlet 16 defining a valve seat 17 through which water in the tank 12 flows to the toilet bowl (not shown). Assembly 10 also includes an overflow pipe 18 secured to the tank 12, and a lift arm 20 that is rotated by operation of a handle 22.

Flow through the outlet 16 is controlled by a flapper flush valve generally designated by the reference numeral 24 and constructed in accordance with the features of the present invention. Valve 24 consists of a one-piece, integral body 26 fabricated as by molding from vinyl or similar elastomeric material. Formed on one end of the body 26 is a hollow float or valve member 28 of a configuration that forms a seal with the valve seat 17 when the valve 24 is in its normal or closed position. The float is encircled by an integral top flange 30, and a plurality of struts or stiffeners 32 prevent deformation of the float under stress or water pressure.

Defined on the opposite end of the body 26 is a torque beam 34 that is connected to the float 28 by planar portions or arms 36 and 38. The beam 34 extends along the full width of the valve 24 and is of sufficient dimension to transmit along its entire length the torsional forces imparted at either end of at its center without significant distortion.

The valve 24 may be mounted in the tank 12 in several different ways. The normal method employs the overflow pipe 18. More specifically, fabricated on the valve body 26 is a mounting collar 40. The collar 40 is formed on an extension 42 of the body 26 which is connected to the beam 34. The collar 40 is of a dimension and configuration to allow it to be placed around the overflow pipe 18 thereby securing the valve 24 to the tank 12. The extension 42 includes struts or stiffeners 44 that serve to anchor the collar 40 relative to the body 26 and to prevent rocking or tilting of the float 28 by maintaining the extension 42 and beam 34 in the desired plane normal to the pipe 18.

A second method of mounting the valve 24 in a toilet tank employs mounting tabs 46 and 48 molded on arms 36 and 38, respectively. These tabs 46 and 48 include apertures 50 and 52, respectively, permitting the valve 24 to be mounted on a overflow pipe that includes extensions or wires that pass through the apertures 50 and 52 in a manner well known in the art. Since this mounting method does not require the use of the collar 40, the arms 36 and 38 are severed in the region between tabs 46 and 48 and beam 34, thereby removing the beam 34 and the collar 40.

In accordance, with an important feature of the present invention, integrally fabricated on the top flange 30 of the float 28 is a lift strap 58. The lift strap 58 is molded as an integral part of the valve 24 and is intended to engage an aperture 60 in the lift arm 20 to connect the float 28 to the arm 20. In this manner, flow through the outlet 16 is controlled by operation of the handle 22. More specifically, rotation of the handle 22 is transmitted to the float 28 by the lift strap 58 causing the float 28 to unseat from seat 17 allowing flow of the water in the tank 12 through the outlet 16.

To attach the strap 58 to the arm 20, the strap 58 includes a plurality of rachet-like teeth generally designated as 62. The teeth 62 and the strap 58 are intended to be introduced into aperture 60. Each tooth 62 includes a cam surface 64 that allows the strap 58 to be pushed into and pulled through the aperture 60 until the strap 58 is relatively taut in the closed position between the arm 20 and the valve 24. In order to prevent inadvertant withdrawal of the strap 58 from the arm 20, each tooth 62 also includes a locking surface 66 adjacent the cam surface 64 that engages the periphery of the aperture 60 and prevents the removal of the strap 58 from the aperture 60 once inserted.

The employment of the integral lift strap 58 makes it desirable that the material of the valve 24 be of a hardness of more than about 55 durometer, for example, 60–65 durometer, as opposed to the material of approximately 30 durometer employed in prior art valves. This harder material insures that the strap 58 is of sufficient strength.

Since the valve 24 is subjected to repeated rotations about its point of mounting to the tank 12 due to the lifting of the float 28, the harder material is likely to deteriorate and crack because it is less flexible than the softer material of the prior art valves. To compensate for the deleterious effects to this stiffer material as a result of the torsional forces imparted to the body 26 as the float 28 is raised by the handle 22, a compound hinge generally designated as 68 is fabricated in the valve body 26 adjacent the torque beam 34. The hinge 68 is a reduced portion of the body 26 and includes outer hinges 70 and 72 fabricated in the planar portions 36 and 38, respectively, and an inner hinge 74 defined in the extension 42. This reduced thickness allows flexing even in the stiff material of the valve 24. To minimize flexure of the planar portions 36 and 38 and to assist in transmitting substantially all of the torsional force to the hinge 68, there are stiffeners 76 and 78 fabricated on the portions 36 and 38, respectively.

The hinge 68 serves to concentrate and absorb substantially all of the torsional force experienced by the valve 24 as the float 28 is lifted. More specifically, when the flush valve 24 is activated by the handle 22, the lift arm 20 is raised lifting the float 28 out of the seat 17. This rotation or lifting of the float 28 is imparted to the outer hinges 70 and 72 by the arms 36 and 38. As previously mentioned, to minimize rotation or bending of the arms 36 and 38 and, thus, deterioration, stiffeners 76 and 78 are molded on the arms 36 and 38, respectively to maintain the arms 36 and 36 relatively rigid.

Figure 5:
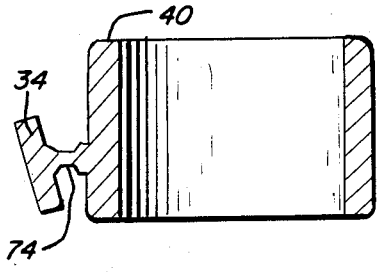
FIG. 5 is a fragmentary, sectional view taken along line 5—5 in FIG. 2.

As the float 28 is raised and the arms 36 and 38 rotate about the hinges 70 and 72, the relatively rigid torque beam 34 apportions the total rotation among the hinges 70 and 72 and the hinge 74. The rotation of the hinges 70 and 72 is transmitted by the beam 34 to the inner hinge 74. Since the mounting collar 40 is secured to the relatively immovable overflow pipe 18, and the extension 42 is maintained rigid relative to the collar 34 by the stiffeners 44; the beam 34 rotates about the hinge 74 relative to the stationary collar 40 (FIG. 5).

Accordingly, the outer hinges 70 and 72 share the full rotation of the float 28 with the inner hinge 74 in proportion to their total lengths. Thus the valve 24 is easy to rotate and since the magnitude of flexing at each of the hinges 70, 72 and 74 is less than that experienced if there were only one hinge, the life of the valve 24 is substantially increased. In the illustrated arrangement, the combined total length of the outer hinges 70 and 72 roughly equals the length of the inner hinge 74, the total amount of rotation shared by the outer hinges 70, and 72 substantially equals the amount of rotation experienced by the inner hinge 74. In this manner, the rotation of the float 28 is concentrated at the hinges 70, 72 and 74 and is shared such that the material of the valve 24 is not subjected to forces of a magnitude sufficient to cause failure or deterioration thus allowing the employment of a harder material in the fabrication of the valve 24.

While the invention has been described with reference to details of the illustrated embodiment, it should be understood that such details are not intended to limit the scope of the invention as defined in the following claims.

What is claimed and desired to be secured by Letters Patent of the United States is:

1. A one-piece flush valve for use with a toilet tank assembly including a flush outlet surrounded by a valve seat; an overflow pipe, and a lift arm movable to initiate flow through said valve seat; said flush valve comprising:

a one-piece, integral body of molded vinyl or similar thermoplastic material; said body including a float member defined adjacent one end thereof;

a planar portion of said body extending laterally from said float member;

a mounting structure formed integrally with said body and including means for mounting said body on the overflow pipe with said float member aligned with the valve seat;

strap means for lifting said body consisting of an elongated graduated lift strap formed integrally at one end with said body adjacent said float member such that said body and strap define a one-piece valve, said strap adapted to extend from said float member to the region of the lift arm, said strap being sufficiently non-stretchy so that when in operation under tension by said lift arm in lifting said float member, it will properly lift said float member, and said strap being sufficiently supple so as not to intefere with the floating of said float, but being sufficiently stiff that no portion of it can fall into said valve seat or otherwise interfere with the valve operation when said float member is floating and the lift arm has been released to its non-lifting position;

attaching means formed adjacent the free end of said lift strap for interconnecting said lift strap and said lift arm and flexure means defined adjacent a second end of said body for allowing said float to flex relative to said second end of said body without undue stress on said body material;

said flexure means including a torque beam defined adjacent a second end of said body laterally spaced from said float, said beam formed integrally with said planar portion;

said planar portion of said body extending from said float being integrally formed with a first portion of said beam, and said mounting structure including a planar portion formed with said mounting structure and integrally formed with a second portion of said beam; and said flexure means further including a first hinge fabricated adjacent said beam on said planar portion of said body extending from said float and a second hinge fabricated adjacent said beam on said planar portion formed with said mounting structure.

2. A flush valve for use in a toilet tank assembly including a flush valve seat and an overflow pipe said flush valve comprising an integral and unitary molded elastomeric body including a float member adjacent one end of the body adapted to engage the flush valve seat, a relatively rigid beam member adjacent the opposite end of the body, a mounting collar defined on said body between said float member and said beam member and adapted to encircle the overflow pipe, said beam member having a length greater than the width of said collar, a first interconnecting portion extending from said collar to a central portion of said beam member, a pair of second interconnecting portions extending from end portions of said beam member to said float member, said second portions being located on opposite sides of said collar, a first integral hinge of reduced thickness relative to said first portions formed in said first portion for permitting said beam member to pivot with respect to said collar, and second integral hinges of reduced thickness relative to said second portions in each of said second portions for permitting said float member to pivot with respect to said beam member.

3. The flush valve claimed in claim 2 further comprising a strap formed integrally with said float and including a plurality of ratchet teeth, one side of each defining a cam surface.

4. The flush valve claimed in claim 2, said elastomeric body being fabricated from a material having more than approximately 55 durometer hardness.

* * * * *